United States Patent [19]

Long et al.

[11] Patent Number: 4,493,765

[45] Date of Patent: Jan. 15, 1985

[54] SELECTIVE SEPARATION OF HEAVY OIL USING A MIXTURE OF POLAR AND NONPOLAR SOLVENTS

[75] Inventors: Robert B. Long, Atlantic Highlands; Fred A. Caruso, Elizabeth, both of N.J.

[73] Assignee: Exxon Research and Engineering Co., Florham Park, N.J.

[21] Appl. No.: 501,197

[22] Filed: Jun. 6, 1983

[51] Int. Cl.[3] ..... C01G 21/04; C01G 21/06

[52] U.S. Cl. ..... 208/309; 208/323; 208/321; 208/45

[58] Field of Search ..... 208/45, 96, 309, 314, 208/315, 321, 323

[56] References Cited

U.S. PATENT DOCUMENTS

| | | | |
|---|---|---|---|
| 2,092,739 | 9/1937 | Van Dijck | 208/309 X |
| 2,161,567 | 6/1939 | Gee et al. | 208/315 |
| 2,859,172 | 11/1958 | Reymond | 208/335 X |
| 2,928,788 | 3/1960 | Jezl | 208/314 |
| 2,937,135 | 5/1960 | Middleton | 208/323 |
| 3,053,750 | 9/1962 | Beuther et al. | 208/309 |
| 3,053,751 | 9/1962 | Garwin | 208/45 |
| 3,079,326 | 2/1963 | Neuworth | 208/323 |
| 3,108,061 | 10/1963 | Meier | 208/309 |
| 3,278,415 | 10/1966 | Doberenz et al. | 208/309 X |
| 3,291,718 | 12/1966 | Biribauer et al. | 208/309 X |
| 3,306,849 | 2/1964 | Bozeman, Jr. et al. | 208/314 |
| 3,321,394 | 5/1967 | Mills | 208/309 |
| 3,334,043 | 8/1967 | Ferris et al. | 208/45 X |
| 3,565,795 | 2/1971 | Sproule et al. | 208/332 |
| 3,627,675 | 12/1971 | Ditman | 208/309 |
| 3,682,815 | 8/1972 | Flack et al. | 208/314 |
| 3,798,157 | 3/1974 | Manzanilla et al. | 208/309 X |
| 3,975,396 | 8/1976 | Bushnell et al. | 208/309 |
| 3,985,644 | 10/1976 | Eberly, Jr. | 208/321 |
| 4,013,549 | 3/1977 | Bushnell | 208/323 |
| 4,101,415 | 7/1978 | Crowley | 208/45 |
| 4,191,639 | 3/1980 | Audeh et al. | 208/309 |
| 4,305,812 | 12/1981 | Shih et al. | 208/309 |
| 4,321,216 | 3/1982 | Delgado | 260/504 R |
| 4,324,651 | 4/1982 | Rollmann et al. | 208/45 X |
| 4,325,818 | 4/1982 | Woodle | 208/326 |

FOREIGN PATENT DOCUMENTS

| | | | |
|---|---|---|---|
| 613224 | 1/1961 | Canada | 208/321 |
| 1085334 | 9/1980 | Canada | 208/321 |
| 2081297 | 2/1982 | United Kingdom . | |

OTHER PUBLICATIONS

N. Marculescu et al., Chem. Oil Gas, 7(3), (1971).

Moschopedis et al, *Fuel*, 1976, vol. 55, p. 227 ff.

*Primary Examiner*—Delbert E. Gantz

*Assistant Examiner*—Glenn A. Caldarola

*Attorney, Agent, or Firm*—E. Thomas Wheelock

[57] ABSTRACT

A hydrocarbon feedstock may be selectively separated into its various fractions by contact with a mixture of specified polar and nonpolar solvents at a temperature so as to form a two-phase system, separating the first extract and raffinate phases so obtained, cooling the raffinate (nonpolar) phase so that three phases form, and separating the three phases. The three phases obtained consist of the polar solvent containing low molecular weight polars, the nonpolar solvent containing the saturates and aromatics, and an asphaltene-containing phase. The asphaltene-containing phase may be further washed to yield an asphalt with a higher microcarbon residue than the non-washed asphalt.

19 Claims, 2 Drawing Figures

SELECTIVE SEPARATION OF HEAVY OIL USING A MIXTURE OF POLAR AND NONPOLAR SOLVENTS

BACKGROUND OF THE INVENTION

1. Field of the Invention

The present invention relates to the refining of hydrocarbon feedstocks. More particularly, this invention concerns a selective separation of a heavy oil feed into polar and nonpolar fractions using a specified double solvent extraction system.

2. Description of Relevant Art

Hydrocarbon feedstocks, whether derived from natural petroleum or synthetic sources, are composed of hydrocarbon and non-hydrocarbon (e.g., heteroatom containing organic molecules) components which differ in boiling point, molecular weight and chemical structure. High boiling, high molecular weight non-hydrocarbons (e.g., asphaltenes) are known to contain a greater proportion of carbon-forming constituents (i.e., coke precursors) than lower boiling naphtha and distillate fractions. Because coke precursors form coke during thermal processing (such as is employed in a modern refinery), it is desirable to remove (or at least segregate) the non-hydrocarbon components containing the coke precursors, thereby facilitating further processing of the more valuable fractions of the feedstock. One method often utilized for this segregation is solvent deasphalting.

Deasphalting is a solvent extraction process utilizing a light hydrocarbon solvent (e.g., propane, butane, pentane or heptane) to separate heavy hydrocarbon feedstocks into a deasphalted oil and a low value residue or asphalt which contains asphaltenes. See, e.g., U.S. Pat. No. 3,132,088. Unfortunately, in the typical technique, the separation is not selective in that much of the more valuable deasphalted oil is precipitated with the residue while hydrocarbons containing coke precursors are extracted with the deasphalted oil. Thus, such a technique only partially segregates the coke precursors from the more valuable fractions and results in a significant portion of the more valuable product inherently and unavoidably remaining with the coke precursor rich residue. This is particularly so with heavy crudes and oils.

Solvent extractions and various other techniques have been proposed for preparation of Fluid Catalytic Cracking (FCC) charge stock from resids. Solvent extraction, in common with propane deasphalting, functions by selection on chemical type, rejecting from the charge stock the aromatic compounds which can crack to yield high octane components of cracked naphtha. Low temperature, liquid phase sorption on catalytically inert silica is described by Shuman et al., *Oil and Gas Journal,* Apr. 6, 1953, page 113. U.S. Pat. Nos. 3,565,795 and 3,567,627 describe a method of separating polar materials such as high molecular weight aromatics from petroleum distillate fractions by selective solvent extraction.

The literature discloses many variations of the solvent extraction process. Thus, U.S. Pat. No. 2,928,788 discloses solvent recovery by cooling, and U.S. Pat. No. 3,177,196 discloses solvent recovery by re-extraction. U.S. Pat. Nos. 3,492,365 and 3,186,937 describe separation of aromatic from non-aromatic hydrocarbons using a two-stage extraction zone. U.S. Pat. No. 3,205,167 discloses cooling intermediate extracts so as to obtain by phase rejection an intermediate quality heart-cut raffinate.

Other patents dealing with solvent extraction processes include U.S. Pat. No. 3,280,024, which discloses a conventional duo-solvent type extraction process for separating naphthalenic hydrocarbons from mixtures using a liquid-liquid extraction procedure, wherein the extractants are complementary polar and nonpolar solvents. U.S. Pat. No. 3,317,422 teaches successive extractions with the same solvent, and U.S. Pat. No. 3,779,896 discloses single-solvent combination extraction and deasphalting. U.S. Pat. No. 4,125,458 relates to a process of simultaneously deasphalting and extracting an asphalt-containing mineral oil with a solvent mixture of a $C_2$–$C_{10}$ hydrocarbon and NMP, with the solvent recovered by cooling. U.S. Pat. No. 3,682,815 discloses another Duo-Sol extraction process using a split feed of polar solvent. In addition, U.S. Pat. No. 4,305,812 discloses dual solvent deasphalting by polarity gradient extraction. U.K. Pat. Pub. No. 2,081,297A also discloses a dual solvent refining process using NMP. Canadian Pat. Nos. 613,224 and 1,085,334 and U.S. Pat. Nos. 3,278,415 and 2,092,739 teach dual solvent extraction methods. See also U.S. Pat. No. 3,291,718 and 3,975,396.

It is also known from U.S. Pat. No. 4,321,216 to deoil hydrocarbon sulfonates using a mixture or solvent system comprising a polar and nonpolar component. U.S. Pat. No. 4,325,818 discloses a dual solvent process for refining oil stocks using N-methyl-2-pyrrolidone to dissolve the aromatics fraction and a highly paraffinic oil as a backwash solvent.

It is known from U.S. Pat. No. 2,937,135 to employ two substantially immiscible liquid solvents to extract polynuclear aromatic materials.

U.S. Pat. No. 4,354,928 discloses deasphalting and extracting of a petroleum oil with a solvent maintained at its critical temperature and pressure so that extraction is effected by vapor-liquid phase separation.

U.S. Pat. No. 2,273,661 discloses a method for refining heavy oil by selective solvent extraction with a mixture of solvents, one which dissolves hydrocarbons of high hydrogen-carbon ratio, correlating the proportions of solvents to the temperature at which the oil is to be treated.

Finally, U.S. Pat. No. 3,380,912 discloses a combination extraction-demetalization process for heavy oils using a second extraction zone where the asphaltene-containing material is contacted with a solvent to extract aromatics and a solvent which causes rejection of the asphaltene into the extract or heavier phase.

SUMMARY OF THE INVENTION

According to the present invention it has been discovered that by use of a temperature-dependent double-solvent extraction process wherein certain defined polar and nonpolar solvents are employed, the asphaltenes of a hydrocarbon feedstock concentrate in the raffinate phase at a minimum elevated temperature. Upon cooling of the raffinate phase the mutual solubility of the polar and nonpolar solvents in the raffinate decreases, causing the asphaltenes to precipitate from the solvent system. The asphaltene-containing phase obtained is of very poor quality, indicating that a very effective selective separation of the saturates from the aromatics fraction has occurred.

More particularly, the present invention relates to a process for selectively separating a hydrocarbon feedstock which comprises:

(a) contacting the feedstock with a nonpolar solvent having an overall solubility parameter of less than about 8.0 and a polar solvent having an overall solubility parameter greater than about 11.0 in amounts such that the average overall solubility parameter for the mixture of polar and nonpolar solvents is between about 9.5 and 10.0, said contacting taking place at, or the resulting mixture being subjected to, a temperature from about 5° to about 20° C. below the critical solution temperature of the mixture so as to form a two-phase mixture consisting of a first extract phase comprising a minor amount of the nonpolar solvent and a major amount of the polar solvent and a first raffinate phase comprising a minor amount of the polar solvent and a major amount of the nonpolar solvent;

(b) separating the first extract phase from the first raffinate phase;

(c) cooling the separated first raffinate phase by at least about 30° C. so as to cause phase separation of the polar and nonpolar solvents into final extract and final raffinate phases, respectively, whereby asphaltenes separate as a third phase; and (d) separating the final extract phase, the final raffinate phase and the asphaltene-containing phase from step (c).

In a particularly preferred embodiment the process is carried out in a continuous manner and includes the additional steps of:

(e) contacting the asphaltene-containing phase from step (d) with a nonpolar solvent having an overall solubility parameter of less than about 8.0 so that the solvent removes from the asphaltene-containing phase at least a portion of its non-asphaltene components, (f) separating the solvent from the asphaltene-containing phase, and (g) recycling the solvent to use in step (a).

The latter three steps are found to effect an even more selective separation because the nonpolar solvent further refines the asphaltene-containing phase and recovers any desirable materials contained therein.

The invention herein is based on the discovery that on heating the mixture of feedstock, polar solvent and nonpolar solvent to form a raffinate phase and an extract phase, the asphaltenes and saturates are in the raffinate phase at higher temperature, and upon cooling the raffinate phase, a three-phase system, including a rejected asphaltene-containing phase, is formed. The method herein, in particular, represents an efficient process for removing low molecular weight polars from heavy oil feedstocks.

DETAILED DESCRIPTION OF THE PREFERRED EMBODIMENTS

Figure 1:
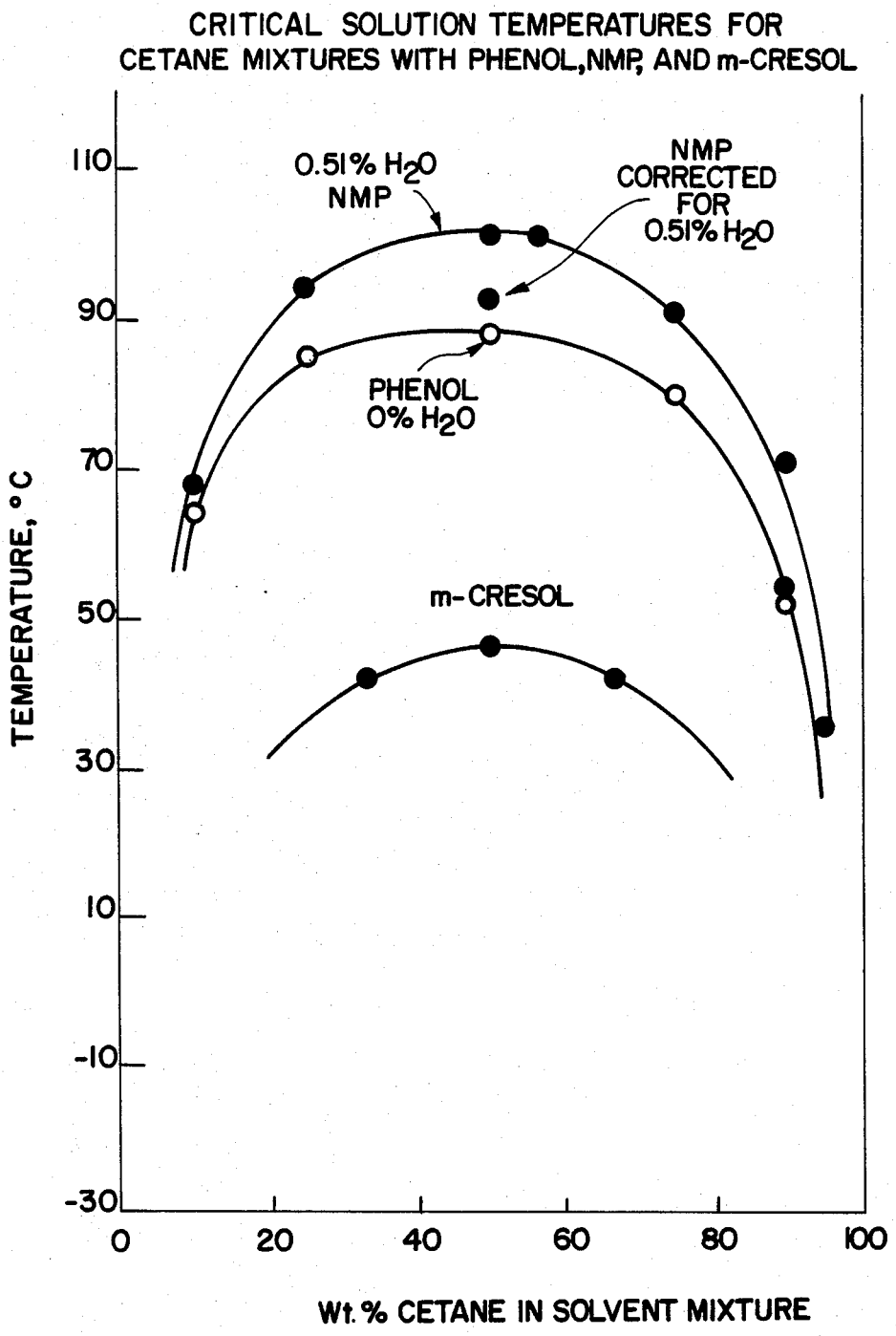
FIG. 1 illustrates a plot of the critical solution temperatures of three cetane-containing binary solvent mixtures as a function of the amount of cetane therein relative to the amount of NMP, phenol or m-cresol therein, respectively. (No feedstock is present in the mixture).

The hydrocarbon feedstock which may be treated by the process of this invention may be virtually any hydrocarbon feedstock, be it whole crude or one or more fractions thereof. This invention is particularly applicable to heavy hydrocarbon feedstocks, such as atmospheric or vacuum resids, which tend to have increased quantities of Conradson carbon residue—normally at least 10 wt.%. Typically, less than 10 volume % of the heavy hydrocarbon feedstocks will have an initial feedstock boiling point of less than about 343° C. The feedstock can be additionally derived from practically any source. Thus, suitable hydrocarbon (heavy oil) feedstocks include heavy crudes, petroleum residua and similar hydrocarbons derived from synthetic sources such as coal, tar sands, shale oils, biomass and the like. Although heavy hydrocarbon feedstocks are preferred for use in this invention, the preset technique can be readily applied to lighter boiling feedstocks (such as distillates) from petroleum and synthetic sources. In particular, the feedstock may be derived from a synthetic liquid such as shale oil, coal liquid, or mixtures thereof.

In the first step of the process of the present invention the hydrocarbon feedstock described above is contacted with a mixture of a nonpolar solvent and a polar solvent defined by their overall solubility parameters (which is a measure of their polarity) and by their miscibility at certain temperatures.

By proper selection of the polar and nonpolar solvents employed, the feedstock can be cleanly and readily separated into a saturates plus aromatics fraction, a low molecular weight polars fraction and an asphaltene-containing phase, all of which fractions may be upgraded by further processing. The saturates plus aromatics fraction generally comprises paraffins, single and multi-ring cycloparaffins, single ring aromatics, condensed ring aromatics and aromatic sulfur compounds such as thiophenes. The saturates fraction may be defined by its affinity for absorption on dried Attapulgus clay or neutral alumina and is that fraction of the feedstock which would be desorbed (or eluted) with cyclohexane. The aromatics fraction is that fraction which would be desorbed with toluene (after removal of the saturates fraction). The low molecular weight polars fraction contains sulfur-, nitrogen- and oxygen-containing compounds similar to the compounds in the asphaltene-containing fraction but of lower molecular weight, i.e., a molecular weight less than about 1000. The asphaltene-containing fraction is that fraction which remains after the other fractions have been desorbed and contains high molecular weight polar carbon-forming constituents, otherwise known as coke precursors, which may contain heteroatoms such as nitrogen, oxygen and sulfur; this fraction also contains certain metals such as vanadium and nickel. The coke precursors in the asphaltene-containing fraction are particularly undesirable because they form coke during thermal processing. The greater the separation among these fractions the better the yield of the valuable nonpolar saturates plus aromatics fraction.

The overall solubility parameter (also known as the overall Hildebrand solubility parameter) which is used to define the applicable solvents herein is a well known measure of polarity and has been tabulated for numerous compounds. See, for example, J. H. Hildebrand et al., The Solubility of Non-Electrolytes, Dover Publications, Inc., New York (1964); Barton, A.F.M., "Sobubility Parameters", Chem Reviews, 75, No. 6 (1975); and Kirk-Othmer, The Encyclopedia of Chemical Technology, 2nd Ed., Supplement Volume, pp. 889–910, Interscience Publishers, New York (1971), the entire disclosure of each publication being incorporated herein by reference.

In accordance with this invention the nonpolar solvent (or solvents, if more than one is employed) must have an overall solubility parameter of less than about 8.0, preferably less than about 7.8. The nonpolar solvent also should have a relatively low volatility and viscosity at temperatures of over 100° C. Suitable solvents include, e.g., saturated aliphatic hydrocarbons such as hexane, n-heptane, paraffinic naphthas and kerosenes, $C_9$–$C_{15}$ normal and branched paraffins, cetane (n-hexadecane), mixtures or any of these solvents, and the like. Preferably, the nonpolar solvent is a saturated hydrocarbon containing at least six carbon atoms, such as n-heptane, and more preferably is a kerosene-range (i.e., $C_{12}$ to $C_{16}$) paraffin such as cetane, which has a higher molecular weight and thus a higher boiling point.

According to this invention, the polar solvent (or solvents, if more than one is employed) must have an overall solubility parameter greater than about 11.0, preferably greater than about 11.2. Examples of polar solvents meeting the minimum solubility parameter of about 11.0 include N-methyl-2-pyrrolidone (NMP), methanol, phenol, aniline, m-cresol, gamma-butyrolactone, dimethylformamide, dimethyl sulfone, ethylene carbonate, furfural, nitrobenzene, mixtures thereof, and the like. Preferred polar solvents herein are N-methylpyrrolidone, phenol and m-cresol, and most preferred is N-methylpyrrolidone. It may be desirable to have minor amounts of water or ethylene glycol present in the polar solvent to facilitate the separation. Thus, amounts of water up to about 5% by weight of the total solvent or of ethylene glycol up to about 20% by weight of the total solvent may be added to or already present in the solvent.

The relative amounts of the solvents to be added are also an important feature of this invention. These amounts must be such that the average overall solubility parameter for the mixture of polar and nonpolar solvents is between about 9.5 and 10.0. This average value should approximate 9.6, which is the approximate overall solubility parameter for virgin asphaltenes as was determined by solvent uptake studies, because the objective herein is to dissolve the maximum amount of asphaltenes possible so as to achieve maximum separation of desirable fractions therefrom. The exact relative amounts employed will depend mainly on the solvents utilized and the amount of asphaltenes in the feedstock. The average parameter may be determined by volumetric blending of the values for the individual solvents.

Specific examples of suitable combinations of polar and nonpolar solvents which may be so mixed so as to be effective in the process herein include hexane and phenol, n-heptane and methanol, n-decane and methanol, cetane and NMP, n-heptane and phenol, cetane and phenol, cetane and m-cresol, and n-heptane and NMP. In addition, the solvent mixture may contain an effective amount (generally up to about 5% by weight) of a polar compound such as water, glycol, etc. to maintain workable viscosities. The polar compound will typically have a polarity defined by an overall or total Hildebrand solubility parameter greater than 9.0 and a complexing solubility parameter greater than 1.3.

The overall Hildebrand solubility parameter is a well-known measure of polarity and has been tabulated for numerous compounds (see, for example, Hildebrand, J. H. and Scott, R. L. The Solubility of Non-Electrolytes, Dover Publications, Inc., New York (1964); Barton, A.F.M., "Solubility Parameters", Chem Reviews, 75, No. 6 (1975); and Kirk-Othmer, The Encyclopedia of Chemical Technology, 2nd Ed., Supplement Volume, pp. 889–910, Interscience Publishers, New York (1971), the entire disclosure of each publication being incorporated herein by reference). The complexing solubility parameter is discussed in Kirk-Othmer, supra, described by Dickerson and Wiehe (see C. G. Dickerson and I. A. Wiehe "Spherical Encapsulated Polymer Particles by Spray Drying", Proc. Second Pacific Chemical Engineering Congress, Vol. II, 243 ) 1977, the entire disclosure of which is incorporated herein by reference) and can be derived readily from the Hildebrand solubility parameter by subdividing the latter into a complexing component and a Van der Waals component. Thus, by proper consideration of both solubility parameters, one can select suitable polar compounds for use herein.

The contacting of the feedstock with the two types of solvents is carried out, and/or the mixture is maintained, at a temperature of from about 5 to about 20° C., preferably from about 5° to 10° C., below the critical solution temperature of the mixture. The critical solution temperature is defined herein as the highest temperature at which the particular mixture of solvents and feedstock becomes miscible, i.e., the solvents form only one homogeneous phase. It will be noted that the critical solution temperature of the mixture will be increased if the polar compound mentioned above is present therein. The temperature to which the components of the mixture are exposed will thus maintain the solvent-feedstock system as a two-phase system. The exact temperatures which will be employed for this purpose depend on many factors such as the specific feedstock utilized and particular solvent system employed. As to specific binary solvent systems, FIG. 1 illustrates the critical solution temperatures for cetane-phenol, cetane-NMP and cetane-m-cresol mixtures as a function of the amount of cresol in the mixture with no feedstock present. The plots, which are highly dependent on the solvent system, are relatively parabolic and indicate that the highest critical solution temperatures exist for 50:50 mixtures of the solvents. FIG. 1 also illustrates that the presence of water increases the critical solution temperature. The practitioner would employ contacting temperatures from about 5° to 20° C. below the temperatures on the lines of the corresponding plots where feedstock is present in the solvent mixtures.

In addition, the temperatures employed during the contacting must be sufficient to achieve relatively low phase viscosities in continuous countercurrent towers if such towers are employed to extract the solvents. As mentioned above, the temperature may be maintained at the proper level for this optimum phase interaction by adding a polar compound such as water, ethylene glycol or the like to the solvent mixture in an effective amount. Addition of such an additive is particularly preferred as the molecular weight of the non-polar solvent increases, because the polar additive allows achievement of higher temperatures so as to maintain workable viscosity levels. The time for contact at the appropriate level will be that time necessary to achieve equilibration of the mixture, which will depend mainly on the temperature and the components of the mixture.

One of the two phases formed during this contacting period where the temperature is adjusted to the appropriate level, designated as the first raffinate, will generally contain the asphaltenes, saturates, aromatics, and a small amount of low molecular weight polars from the feedstock, as well as a minor amount (less than 50% by total weight of solvent in the first raffinate) of the polar solvent and a major amount (at least 50% by weight of the total solvent in the first raffinate) of the nonpolar solvent. The second phase, designated as the first extract, generally contains low molecular weight polars from the feedstock along with a major amount (at least 50% by weight of the total solvent in the second phase) of the polar solvent and a minor amount (less than 50% by weight of the total solvent in the second phase) of the nonpolar solvent. Thus, on adjusting the temperature to the appropriate level below the critical solution temperature, as a general rule the asphaltenes, saturates and high molecular weight aromatics concentrate in the raffinate phase, the low molecular weight polars concentrate in the extract phase, and a lack of symmetry exists between the solvent compositions of the respective phases.

If the solvent system from the first phase is chosen according to the parameters defined above, the two phases will contain the components above mentioned without the need for analysis thereof during heating. After formation of the two phases they are separated from each other by any suitable technique desired, such as by use of a centrifuge, settling drum, or baffled settling zone. Preferably, a settling drum is employed for the separation.

After the two phases are separated, the first extract phase containing the low molecular weight polars fraction is treated so as to separate the latter fraction from the polar solvent using a technique such as distillation.

The first raffinate phase containing the asphaltenes, aromatics and saturates is treated as follows to obtain the separate component fractions. First, it is cooled by at least 30° C., so as to cause phase separation of the polar and nonpolar solvents. When the phases separate, three phases are formed generally consisting of a final raffinate phase containing the saturates plus aromatics fraction in the nonpolar solvent, a final extract phase containing the low molecular weight polars in the polar solvent, and an asphaltene-containing phase. The amount of cooling required to achieve this separation will depend mainly on the temperature applied during the contacting step, the specific feedstock employed, and the specific solvents employed. Preferably, however, the cooling is by an amount of about 30° to 80° C. The practitioner will recognize at what specific temperature sufficient cooling has been carried out by observing the formation of three phases, one being the asphaltene-containing phase which will precipitate.

In the final step of the process herein the three phases formed on cooling the first raffinate phase are separated from one another. This separation may be carried out by any suitable technique such as by use of a centrifuge and/or settling drum, but is preferably carried out by using a settling drum. The saturates and aromatics remaining in the final raffinate may be then recovered by removing the nonpolar solvent therefrom by suitable means such as, e.g., by distillation, re-extraction with light polar solvents, e.g., water, and the like.

In a preferred embodiment of this invention the selectivity of the separation is further improved by contacting the asphaltene-containing phase obtained on separation of the three phases with the nonpolar solvent being employed prior to feeding the solvent to the primary higher temperature contacting zone. This contacting is carried out in such a manner that at least a portion, and preferably all, of the remaining non-asphaltene components in the asphaltene-containing phase are removed from the phase. The nonpolar solvent is then separated from the asphaltene-containing phase using a suitable method such as settling or filtration, depending on the physical state of the asphaltenes, and the solvent is then fed to the primary higher temperature contacting stage. This embodiment is particularly useful in a continuous process, as described in detail below, where the same nonpolar solvent that is used in the first step, before being contacted with a new feedstock to be separated, is first contacted with the asphaltene-containing phase from a prior separation so that it scrubs out the non-asphaltene components and leaves only the asphaltene behind.

Any suitable vessel(s) can be used to practice the present invention so long as it is appropriately equipped to handle the various steps involved. The vessel(s) may be equipped with internal supports, baffles, trays, and the like.

Figure 2:
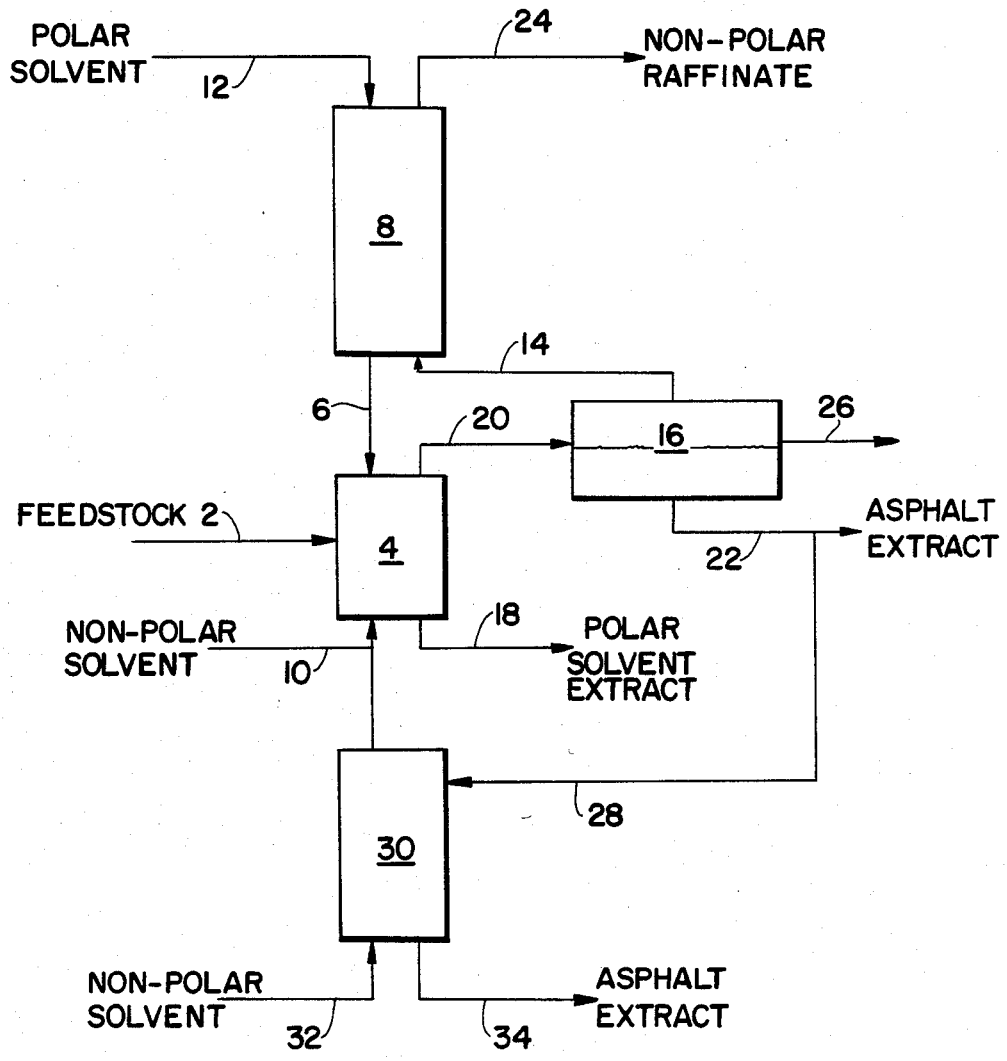
FIG. 2 illustrates a preferred flow diagram for using solvent extraction to effect a selective separation of the feedstock.

The double-solvent extraction process of this invention is particularly suited for being conducted in a continuous mode with reference to the schematic diagram of FIG. 2. As shown in FIG. 2, a heavy oil feedstock from line 2 is contacted in a first contacting zone 4 with an intermediate polar solvent via line 6 from a second contacting zone 8 and with a nonpolar solvent introduced through line 10. The nonpolar solvent for this modification of the invention must be of a higher molecular weight than propane and preferably is a kerosene-range paraffinic solvent. The intermediate polar solvent extract from line 6 is formed in the second contacting zone by contacting a polar solvent introduced via line 12 (e.g., NMP) with an intermediate nonpolar raffinate phase 14 from a third contacting zone 16.

First contacting zone 4 may be any apparatus suitable for obtaining an intimate mixture of hydrocarbon feedstock and solvents at temperatures up to and above 100° C. such as a contacting tower or a mixer-settler. Any apparatus suitable to effect liquid-liquid extraction may be used as the second contacting zone such as a packed column or sieve plates. Preferably, a countercurrent contacting tower is employed. Third contacting zone 16 may be any apparatus where cooling of the liquid phases may take place, such as a cooler-settler where the asphaltene-containing phase settles to the bottom.

From first contacting zone 4 a first extract phase 18 is obtained containing the low molecular weight polars fraction which may be separated therefrom by suitable techniques not shown. Also obtained from contacting zone 4 is a first raffinate phase 20, which upon cooling in third contacting zone 16 forms three phases. The densest phase is the asphaltene-containing phase, which settles to the bottom and is removed from zone 16 via line 22 for disposal or subsequent treatment. The nonpolar solvent (final raffinate) phase is removed from zone 16 via line 14 and undergoes further purification by contact with the polar solvent 12 in second contacting zone 8, thereby forming the intermediate polar solvent extract 6 and a purified nonpolar solvent raffinate containing the saturates plus aromatics fraction which is removed from zone 8 via line 24. The saturates and aromatics may be removed from the nonpolar solvent by any suitable means not shown. The polar solvent (final extract) phase in the third contacting zone 16 may be removed via line 26 or along with the asphaltenes via line 22 for disposal or subsequent treatment. By the process thus described the low and high molecular weight polars may be removed from the feedstock to obtain an enhanced yield of the nonpolars fraction.

This yield of nonpolars fraction may be further improved by purifying the asphaltene-containing phase being obtained from line 22 (and the polar solvent phase if it is removed with the asphaltenes) by feeding it through line 28 to a fourth contacting zone 30 through which the nonpolar solvent passes after introduction via line 32. Thus, in this embodiment, the nonpolar solvent is introduced to the system through line 32 rather than through line 10 so that it flows upward through zone 30 in continuous intimate contact with the asphaltene-containing phase from line 28, which flows downward through the zone 30 and exits via line 34 with a higher concentration of asphaltenes contained therein. The intermediate nonpolar solvent thus entering first contacting zone 4 will be enhanced is non-asphaltene components from the asphaltene-containing phase for further purification thereof. If the polar solvent phase is also present, the polar solvent is removed in contacting zone 30 and recycled to contacting zone 4. The fourth contacting zone may be any apparatus in which liquid-liquid extraction can be carried out and is preferably a countercurrent contacting tower as is used for second contacting zone 8.

The present invention may be further understood by reference to the following examples, which are not intended to restrict the scope of the claims appended hereto. In the examples all parts and percentages are by weight and all temperatures are in degrees Celsius, unless otherwise noted.

EXAMPLE 1

The separation effected by contacting zones 4 and 16 in FIG. 1 has been modeled in the laboratory. Two volumes of cetane (the nonpolar solvent), one volume of NMP (the polar solvent) and one volume of Cold Lake crude were contacted in a one-liter mechanically stirred glass vessel having a stopcock in the bottom. The solvents and oil were mixed for about one hour at 50° C. and atmospheric pressure. The temperature was maintained at 50° C. by circulating hot oil through a jacket surrounding the glass vessel. The mixture was then allowed to settle for about one hour after which the NMP extract was withdrawn through the stopcock. The remaining mixture was allowed to cool to 250° C. so as to form an asphalt phase and a cetane phase, each of which were withdrawn from the glass vessel. The microcarbon residue and number average molecular weight as determined by vapor pressure osmometer (VPO) of each phase were then determined and are shown in Table 1.

TABLE 1

| | Oil in Cetane Raffinate Phase | Oil in NMP Phase | Asphaltene Phase |
|---|---|---|---|
| Microcarbon residue, wt. % | 10.5 | 19 | 28.4 |
| VPO molecular weight, g/mole | 574 | 542 | 1389 |

TABLE 1-continued

| | Oil in Cetane Raffinate Phase | Oil in NMP Phase | Asphaltene Phase |
|---|---|---|---|

EXAMPLE 2

This example illustrates the amounts of components contained in the final extract and raffinate phases when three different polar solvents are employed using cetane as nonpolar solvent.

One volume of the indicated polar solvent, one volume of cetane and one volume of Arab Heavy Vacuum Resid feedstock were contacted in a one-liter mechanically stirred glass vessel having a stopcock in the bottom. The solvent and oil were mixed for about one hour at the given temperature and at atmospheric pressure. The temperature was maintained by circulating hot oil through a jacket surrounding the glass vessel. The mixture was allowed to settle for about one hour, after which time the upper nonpolar first raffinate was removed by hypodermic needle and the polar solvent extract phase was withdrawn through the stopcock. The final extract and raffinate phases obtained from the first raffinate for each solvent system were evaluated for microcarbon residue, molecular weight and vanadium and nickel contents. The results are indicated in Table 2.

TABLE 2

| | Polar Solvent | | |
|---|---|---|---|
| | m-Cresol (2.2% $H_2O$) | NMP | Phenol (4% $H_2O$) |
| General Conditions | | | |
| Temperature (°C.) | 60 (a) | 70 | 90 |
| Oil in Extract (wt. %) | 21.2 | 15.2 | 10.9 |
| Final Extract Phase | | | |
| Molecular weight (VPO) | 1252 | 849 | 905 |
| Microcarbon Residue of Oil (wt. %) | 36.2 | 33.3 | 32.2 |
| Vanadium (ppm) | 386 | 350 | 394 |
| Nickel (ppm) | 91 | 56 | 79 |
| Final Raffinate Phase | | | |
| Molecular Weight (VPO) | 950 | 965 | 940 |
| Microcarbon Residue of Oil (wt. %) | 18.9 | 20.6 (b) | 21.0 |
| Vanadium (ppm) | 129 | 161 | 168 |
| Nickel (ppm) | 36 | 47 | 47 |
| Ratio of Microcarbon | | | |
| Residue of Oil in Extract: Raffinate | 1.9 | 1.6 | 1.5 |

(a) Totally miscible at 90° C.
(b) By material balance

The results indicated that the order of selectivity for the microcarbon residue for the polar solvents is: m-Cresol greater than NMP greater than phenol. m-Cresol also has the lowest critical solution temperature of the three polar solvents tested as indicated in FIG. 1, thus requiring addition of water for the particular high viscosity feedstock employed. The results also show that for phenol and NMP, the final extracts have a lower molecular weight than the final raffinates, and for all of the solvent systems a higher metal content than the raffinates, indicating that the lower molecular weight polar materials using phenol and NMP and the metals using all three solvent systems concentrate in the extract phase rather than in the nonpolar raffinate phase.

For the phenol and m-cresol extracts the makeup of solvents in the final extract phase and final raffinate phase was evaluated, with the results indicated in Table 3.

TABLE 3

| | Polar Solvent | |
|---|---|---|
| | Phenol (4% $H_2O$) | m-Cresol (2.2% $H_2O$) |
| Solvents in Final Extract Phase (wt. %) | | |
| Cetane | 9.3 | 14.2 |
| Polar Solvent | 86.0 | 82.9 |
| Water | 4.7 | 2.6 |
| Solvents in Final Raffinate Phase (wt. %) | | |
| Cetane | 62.3 | 67.6 |
| Polar Solvent | 37.3 | 32.0 |
| Water | 0.4 | 0.3 |

The results indicate that the final extract phase contains a major amount of the polar solvent (including water) and a minor amount of the nonpolar solvent (cetane), whereas the final raffinate phase contains a major amount of the nonpolar solvent cetane and a minor amount of the polar solvent (including water).

EXAMPLE 3

This example illustrates the concentration of asphaltenes in the first raffinate phase.

The solvent to heavy oil crude ratios of

Example 2 were employed using cetane as nonpolar solvent and NMP or a phenol/ethylene glycol mixture as polar solvent. The phenol/glycol system was contacted at a temperature of 102° C., and the NMP system was contacted at 70° C. The final raffinates from each system were than separated and cooled to 39° C. so as to precipitate asphalts. The content of n-heptane asphaltenes in the heavy oil feedstock, the first raffinate (phenol/glycol) at 102° C., and the precipitated asphalt phase from the first raffinate (NMP) is indicated in Table 4.

TABLE 4

| | Heavy Oil | First Raffinate (Phenol/Glycol) Contacting at 102° C. | Asphalt Precipitate From Cooling First Raffinate (NMP) to 39° C. |
|---|---|---|---|
| Asphaltenes (wt. %) | 19.7 | 23.3 | 38.4 |

The results indicate that the asphaltenes from the heavy oil concentrate in the first raffinate and that upon cooling the first raffinate the asphaltenes precipitate therefrom.

EXAMPLE 4

This example illustrates use of NMP and cetane as solvents in the separation of Arab Heavy Vacuum Residuum (AHVR).

The procedure of Example 1 was employed wherein cetane (nonpolar) and NMP (polar) were utilized as solvents, the volume ratio of AHVR to NMP to cetane was 1:1:1, the contacting step was carried out at 91° C., and the cooling step was carried out at 25° C. The results obtained on analysis of the various phases recovered from the process are indicated in Table 5, wherein "first extract" indicates the polar solvent extract withdrawn through the stopcock, "final extract" indicates the cooled polar solvent extract phase, "final raffinate" indicates the cooled nonpolar solvent phase, and "asphaltenes" indicates the asphaltene-containing phase. The latter three phases were obtained from cooling the separated first raffinate extract.

TABLE 5

| | Phase | | | |
|---|---|---|---|---|
| | First Extract | Final Extract | Final Raffinate | Asphaltenes |
| Properties | | | | |
| Oil in Phase (wt. %) | 16.6 | 31.4 | 40.7 | 39.7 |
| Molecular Weight (VPO) | 862 | 932 | 1144 | 1556 |
| Microcarbon Residue (wt. %) | 27.0 | 18.4 | 20.0 | 38.6 |
| Vanadium (ppm) | 270 | 120 | 138 | 456 |
| Nickel (ppm) | 52 | 30 | 49 | 124 |
| Recovered Solvent Composition (wt. %) | | | | |
| Cetane | 15.6 | 9.7 | 72.0 | 25.2 |
| NMP | 82.0 | 87.9 | 27.7 | 74.0 |
| Water | 2.4 | 2.4 | 0.3 | 0.8 |

The results indicate that the solvent system of NMP and cetane is effective in selectively separating the low molecular weight polars (first and final extracts) from the saturates and aromatics (final raffinate) and the asphaltenes.

EXAMPLE 5

This example illustrates use of phenol and cetane as the solvent system.

The procedure of Example 1 was employed wherein cetane (nonpolar) and phenol containing 4% $H_2O$ (polar) were utilized as solvents, AHVR was used as the heavy oil, the volume ratio of AHVR to phenol to cetane was 1:1:1, the contacting was carried out at 90° C., and the cooling was carried out at 60° C. The results obtained on analysis of the various fractions (phases) recovered from the process are indicated in Table 6, wherein the terms employed are defined in Example 4.

TABLE 6

| | Phase | | |
|---|---|---|---|
| | First Extract | Final Raffinate | Asphaltenes Plus Final Extract |
| Properties | | | |
| Oil in Phase (wt. %) | 10.9 | 39.6 | 24.3 |
| Molecular Weight (VPO) | 905 | 865 | 1468 |
| Microcarbon Residue (wt. %) | 32.2 | 18.6 | 33.2 |
| Vanadium (ppm) | 394 | 98 | 138 |
| Nickel (ppm) | 79 | 32 | 35 |
| Recovered Solvent Composition (wt. %) | | | |
| Cetane | 9.3 | 77.8 | 17.8 |
| Phenol | 86.0 | 21.7 | 80.4 |
| Water | 4.7 | 0.4 | 1.4 |

EXAMPLE 6

This example illustrates use of a mixture of ethylene glycol and phenol as polar solvent and cetane as nonpolar solvent.

The procedure of Example 5 was employed except that a mixture of 20% ethylene glycol and 80% phenol was employed as polar solvent rather than phenol and the initial contacting and cooling temperatures were 175° C. and 102° C. respectively. The high initial contacting temperature led to a single phase, while cooling to 102° C. led to splitting into two phases. The results of inspections of these phases are given in Table 7, with the terms "first extract" and "first raffinate" indicating the two phases obtained. This example shows that 175° C. is too high for the initial contacting temperature with this solvent system, and that temperatures above 100° C. are satisfactory.

TABLE 7

| | Phase | |
|---|---|---|
| | First Extract | First Raffinate |
| Properties | | |
| Oil in Phase (wt. %) | 26.6 | 44.9 |
| Molecular Weight (VPO) | 1015 | 1067 |
| Microcarbon Residue (wt. %) | 22.1 | 21.6 |
| Vanadium (ppm) | 178 | 180 |
| Nickel (ppm) | 54 | 57 |
| Recovered Solvent Composition (wt. %) | | |
| Cetane | 20.5 | 73.1 |
| Phenol | 58.0 | 24.7 |
| Ethylene Glycol | 21.3 | 1.7 |

EXAMPLE 7

This example illustrates use of phenol and cetane as solvent system at higher temperatures.

The procedure of Example 5 was employed except that the contacting and cooling were carried out at 110° C. and 80° C., respectively. Phase separation occurred again at only 80° C., and the analyses of the first extract and raffinate are provided in Table 8.

TABLE 8

| | Phase | |
|---|---|---|
| | First Extract | First Raffinate |
| Properties | | |
| Oil in Phase (wt. %) | 34.6 | 37.7 |
| Molecular Weight (VPO) | 958 | 984 |
| Microcarbon Residue (wt. %) | 21.9 | 19.5 |
| Vanadium (ppm) | 199 | 152 |
| Nickel (ppm) | 56 | 39 |
| Recovered Solvent Composition (wt. %) | | |
| Cetane | 46.3 | 58.5 |
| Phenol | 52.5 | 41.2 |
| Water[a] | 1.0 | 0.33 |

[a]Water evaporated from the solvent at 110° C., leaving these low levels of water remaining.

EXAMPLE 8

This example illustrates use of NMP and cetane as solvent system at a higher temperature.

The procedure of Example 5 was repeated except that NMP was employed rather than phenol. The results are indicated in Table 9.

TABLE 9

| | Phase | | |
|---|---|---|---|
| | First Extract | Final Raffinate | Asphaltenes Plus Final Extract |
| Properties | | | |
| Oil in Phase (wt. %) | 18.6 | 44.7 | 36.9 |
| Molecular Weight (VPO) | 1021 | 1004 | 1052 |
| Microcarbon Residue (wt. %) | 24.1 | 21.0 | 25.7 |
| Vanadium (ppm) | 240 | 163 | 179 |
| Nickel (ppm) | 47 | 44 | 48 |
| Recovered Solvent Composition (wt. %) | | | |
| Cetane | 11.7 | 78.0 | 52.9 |
| NMP | 83.4 | 21.6 | 44.7 |

TABLE 9-continued

| | Phase | | |
|---|---|---|---|
| | First Extract | Final Raffinate | Asphaltenes Plus Final Extract |
| Water | 4.9 | 0.4 | 2.2 |

EXAMPLE 9

This example illustrates use of n-heptane as nonpolar solvent with phenol as the polar solvent.

The procedure of Example 5 was employed except that n-heptane was used as nonpolar solvent and the contacting and cooling temperatures were 70° C. and 30° C., respectively. The system was completely imiscible at 70° C. but split into two first phases at 30° C. The results at 30° C. are indicated in Table 10.

TABLE 10

| | Phase | |
|---|---|---|
| | First Extract | First Raffinate |
| Properties | | |
| Oil in Phase (wt. %) | 23.5 | 45.5 |
| Molecular Weight (VPO) | 1058 | 1028 |
| Microcarbon Residue (wt. %) | 25.4 | 20.3 |
| Vanadium (ppm) | 231 | 149 |
| Nickel (ppm) | 67 | 41 |
| Recovered Solvent Composition (wt. %) | | |
| n-Heptane | 22.4 | 56.1 |
| Phenol | 74.8 | 43.7 |
| Water | 2.8 | 0.1 |

EXAMPLE 10

This example illustrates use of n-heptane and NMP as the solvent system.

The procedure of Example 5 was employed except that n-heptane and NMP (4% $H_2O$) were employed as the solvents and the initial contacting and cooling temperatures were 79° C. and 50° C., respectively. The results are indicated in Table 11.

TABLE 11

| | Phase | | |
|---|---|---|---|
| | First Extract | Final Raffinate | Asphaltenes Plus Final Extract |
| Properties | | | |
| Oil in Phase (wt. %) | 7.4 | 45.5 | 18.5 |
| Molecular Weight (VPO) | 662 | 1100 | 955 |
| Microcarbon Residue (wt. %) | 29.6 | 22.5 | 24.8 |
| Vanadium (ppm) | 366 | 178 | 221 |
| Nickel (ppm) | 39 | 49 | 56 |
| Recovered Solvent Composition (wt. %) | | | |
| n-Heptane | 1.1 | 64.0 | 5.0 |
| NMP | 93.4 | 34.6 | 90.7 |
| Water | 5.2 | 1.2 | 4.0 |

EXAMPLE 11

This example illustrates the effect of reducing the amount of water in the NMP on the selectivity of the separation obtained.

The procedure of Example 5 was repeated using either NMP (4% water), NMP (2% water) or NMP (1% water) rather than phenol as the polar solvent, and using initial contacting and cooling temperatures of 90° C. and 50° C., respectively. The heavy oil feedstock employed in this case was the 510+°C. AHVR used in previous examples. A comparison of the results obtained using each type of NMP as solvent is provided in Table 12.

The results indicate that the addition of increasing amounts of water results in greater phase separation at higher temperatures.

TABLE 12

| | NMP (4% $H_2O$) | | | | NMP (2% $H_2O$) | | | | NMP (1% $H_2O$)[a] | | | |
|---|---|---|---|---|---|---|---|---|---|---|---|---|
| | First Extract | Final Extract | Final Raffinate | Asphaltenes | First Extract | Final Extract | Final Raffinate | Asphaltenes | First Extract (at 50° C.) | Final Extract (at 25° C.) | Final Raffinate (at 50° C.) | Asphaltenes (at 25° C.) |
| Properties | | | | | | | | | | | | |
| Oil in Phase (wt. %) | 7.1 | ND | 43.2 | 32.2 | 16.6 | 31.4 | 40.7 | 54.6 | 15.6 | 34.4 | 40.8 | 47.9 |
| Molecular Weight (VPO) | 727 | ND | 935 | 1390 | 862 | 932 | 1144 | ND | 941 | 930 | 985 | 1685 |
| Microcarbon Residue (wt. %) | 31.3 | 17.0 | 19.3 | 35.0 | 27.0 | 18.4 | 20.0 | 38.4 | 33.0 | 17.4 | 17.3 | 36.1 |
| Vanadium (ppm) | 426 | 93 | 145 | 406 | 270 | 120 | 138 | 468 | 283 | 116 | 107 | 404 |
| Nickel (ppm) | 45 | 29 | 43 | 112 | 52 | 30 | 49 | 133 | 47 | 36 | 35 | 120 |
| Recovered Solvent Composition (wt. %) | | | | | | | | | | | | |
| Cetane | 4.0 | 34.4 | 79.6 | 22.5 | 15.6 | 9.7 | 72.0 | 33.7 | 7.8 | 57.8 | 79.4 | 40.6 |
| NMP | 90.9 | 64.0 | 20.2 | 76.5 | 82.0 | 87.9 | 27.7 | 65.8 | 90.4 | 41.7 | 20.4 | 58.9 |
| Water | 5.1 | 1.6 | 0.2 | 1.0 | 2.4 | 2.4 | 0.3 | 0.5 | 1.8 | 0.5 | 0.2 | 0.5 |

[a]With this solvent there was no phase separation at 90° C. The phases were analyzed at 50° C. and at 25° C.
ND = not determined

EXAMPLE 12

The solubility of Arab Heavy asphaltenes obtained from n-heptane deasphalting of the vacuum residuum was measured in mixtures of NMP with n-heptane at 70° C. and with cetane at 100° C. At these temperatures the solvent pairs were completely miscible but neither solvent alone had appreciable solvent power for the asphaltenes. The results are given in Table 13.

The table illustrates that by mixing two non-solvents for asphaltenes to obtain an intermediate value for the solubility parameter which matches that of the asphaltenes, high solubility of asphaltenes in the mixed solvent can be achieved.

TABLE 13

SOLUBILITY OF AHVR ASPHALTENES IN VARIOUS SOLVENTS

| Solvent | Solubility of AHVR Asphaltenes (wt. %) |
|---|---|
| n-Heptane | 0.0 |
| Cetane at 70° C. | 0.8 |
| NMP at 70° C. | 2.1 |
| NMP at 100° C. | 3.0 (Two Phases) |
| 50:50 NMP/Cetane at 100° C. | 29.1 (Totally Miscible) |
| 50:50 NMP/Heptane at 70° C. | 26.5 (Totally Miscible) |

EXAMPLE 13

This example illustrates the further extractive treatment of the asphaltene-containing phase with non-polar solvent.

Two runs were operated according to the procedure of Example 2 using NMP as polar solvent and cetane or n-heptane as nonpolar solvent. The first raffinate was separated and cooled to 40° C. so as to obtain a final raffinate phase and a phase consisting of asphaltenes and the final extract. The latter phase was washed at the indicated temperature with the indicated amount of the respective nonpolar solvent used to obtain the separation and the solvent was separated from the phase by filtration. The composition of the resulting washed and dried asphaltenes is provided in Table 14, as well as the composition of the unwashed asphaltene.

The results indicate that precontacting the nonpolar solvent with the asphaltene phase prior to sending the nonpolar solvent to the initial contacting stage leads to an asphalt containing higher amounts of microcarbon residue and metals and thus produces a higher yield of good quality oil.

TABLE 14

| | Precipitate Washed with n-Heptane at 25° C. | Precipitate Washed with Cetane at 72° C. | Un washed Precipitate |
|---|---|---|---|
| Properties | | | |
| Molecular weight (VPO) | 4748 | 4750 | 1556 |
| Microcarbon Residue (wt. %) | 57.7 | 56.0 | 38.6 |
| Vanadium (ppm) | 807 | 800 | 456 |
| Nickel (ppm) | 255 | 260 | 124 |
| Nitrogen (ppm) | 1.32 | 0.85 | — |
| Ratio by Weight of Non-Polar Solvent to Precipitate | 10 | 5 | 0 |

EXAMPLE 14

Table 15 supplies information as to the solubility parameters of various suitable polar solvents at 25° C. and of the four fractions of Arab Heavy Vacuum Resid (AHVR) recovered by adsorption-elution separation over Attapulgus clay using the indicated elution solvent.

TABLE 15

| Solvent | Hildebrand Solubility Parameter |
|---|---|
| N—Methyl-2-Pyrrolidone (NMP) | 11.2 |
| Aniline | 11.0 |
| Phenol | 11.8 |
| m-Cresol | 11.1 |
| α-Butyrolactone | 12.0 |
| DMF | 11.8 |
| Dimethylsulfone | 14.6 |
| Ethylene Carbonate | 14.5 |
| Furfural | 11.9 |
| Nitrobenzene | 11.7 |
| Methanol | 14.5 |
| Water | 23.4 |
| Ethylene glycol | 16.1 |
| AHVR | Hildebrand Solubility Parameter |

TABLE 15-continued

| Fraction | AHVR Fraction | Elution Solvent |
|---|---|---|
| Saturates | <8.5 | 8.2 (Cyclohexane) |
| Aromatics | 8.7–9.0 | 8.9 (Toluene) |
| Low Molecular Weight Polars | 9.6–10.0 | 10.2 (5% $H_2O$/95% THF) |
| Asphaltenes | 9.6–10.0 | 10.2 |

In summary, the present invention is seen to provide an improved process for the extractive deasphalting of hydrocarbon feedstocks using a dual solvent technique which selectively separates the low molecular weight polars fraction from the saturates, aromatics and asphaltenes fractions by proper selection of the solvents and the temperatures at which the contacting of the various phases of the fractions occurs.

What is claimed is:

1. A process for the selective separation of a hydrocarbon feedstock containing low molecular weight polars, saturates, aromatics, and asphaltenes which comprises: (a) contacting the feedstock with a nonpolar solvent having an overall solubility parameter of less than about 8.0 and a polar solvent having an overall solubility parameter greater than about 11.0 in amounts such that the volume average overall solubility parameter for the mixture of polar and nonpolar solvents is between about 9.5 and 10.0, said contacting taking place at, or the resulting mixture being subjected to, a temperature from about 5° to about 20° C. below the critical solution temperature of the mixture so as to form a two-phase mixture consisting of a first extract phase comprising a minor amount of the nonpolar solvent, a major amount of the polar solvent and containing a substantial portion of said low molecular weight polars and a first raffinate phase comprising a minor amount of the polar solvent and a major amount of the nonpolar solvent;

(b) separating the first extract phase from the first raffinate phase;

(c) cooling the separated first raffinate phase by at least about 30° C. to produce a final extract phase comprising the substantial remainder of both the polar solvent and the low molecular weight polars; a final raffinate comprising the nonpolar solvent, saturates, and aromatics; and an asphaltene containing phase; and (d) separating the final extract phase, the final raffinate phase and the asphaltene-containing phase formed in step (c).

2. The process of claim 1 wherein the nonpolar solvent is a saturated hydrocarbon containing at least six carbon atoms.

3. The process of claim 1 wherein the nonpolar solvent is n-heptane or cetane.

4. The process of claim 1 wherein the nonpolar solvent is cetane.

5. The process of claim 1 wherein the polar solvent is selected from the group consisting of N-methylpyrrolidone, phenol and m-cresol.

6. The process of claim 4 wherein the polar solvent is N-methylpyrrolidone.

7. The process of claim 1 wherein a polar compound is added to the mixture of solvents in step (a).

8. The process of claim 1 wherein the polar compound is water or glycol.

9. The process of claim 1 wherein the average overall solubility parameter for the mixture of solvents in step (a) is about 9.6.

10. The process of claim 1 wherein during step (a) the mixture is contacted at a temperature from about 5° to 10° C. below the critical solution temperature of the mixture.

11. The process of claim 1 wherein the separating in step (d) is carried out by gravity settling.

12. The process of claim 1 which is conducted in a continuous mode.

13. The process of claim 1 further comprising the steps of:

(e) contacting the asphaltene-containing phase from step (d) with a nonpolar solvent having an overall solubility parameter of less than about 8.0 so that the solvent removes from the asphaltene-containing phase at least a portion of its non-asphaltene components, (f) separating the solvent from the asphaltene-containing phase, and (g) recycling the solvent to use in step (a).

14. The process of claim 12 further comprising the steps of:

(e) contacting the asphaltene-containing phase from step (d) with the nonpolar solvent of step (a) so that the solvent removes from the asphaltene-containing phase at least a portion of its non-asphaltene components, (f) separating the solvent from the asphaltene-containing phase, and (g) recycling the solvent to use in step (a).

15. The process of claim 13 wherein the solvent is separated from the asphaltene-containing phase by filtration.

16. The process of claim 1 wherein less than 10% by volume of the feedstock has an initial boiling point of less than about 343° C.

17. The process of claim 1 wherein the feedstock is a heavy hydrocarbon feedstock.

18. The process of claim 1 wherein the feedstock is derived from a synthetic liquid.

19. The process of claim 18 wherein the synthetic liquid is selected from the group consisting of shale oil, coal liquid and mixtures thereof.

* * * * *